US005865056A

United States Patent [19]

Nagakura

[11] Patent Number: 5,865,056

[45] Date of Patent: Feb. 2, 1999

[54] BENDING METHOD AND APPARATUS FOR EFFECTING CORRECTIVE DISPLACEMENT OF A WORKPIECE

[75] Inventor: Seiju Nagakura, Aichi, Japan

[73] Assignee: Toyokoki Co., Ltd., Aichi, Japan

[21] Appl. No.: 884,757

[22] Filed: Jun. 30, 1997

[30] Foreign Application Priority Data

Apr. 24, 1997 [JP] Japan ..... 9-123063

[51] Int. Cl.[6] ..... B21D 11/22

[52] U.S. Cl. ..... 72/461; 72/420; 72/422; 72/389; 72/18.2

[58] Field of Search ..... 72/441, 461, 420, 72/422, 389, 15.3, 18.2, 18.5; 901/24; 83/269, 367

[56] References Cited

U.S. PATENT DOCUMENTS

| | | | |
|---|---|---|---|
| 4,430,879 | 2/1984 | Rolland | 72/461 |
| 4,494,312 | 1/1985 | Roch | 72/461 |
| 4,831,862 | 5/1989 | Ohashi et al. | 72/461 |
| 5,058,406 | 10/1991 | Sartorio et al. | 72/420 |

FOREIGN PATENT DOCUMENTS

| | | | |
|---|---|---|---|
| 63-5823 | 1/1988 | Japan | 72/461 |
| 3-110018 | 9/1989 | Japan . | |
| 4-309414 | 4/1991 | Japan . | |
| 3-110022 | 5/1991 | Japan | 72/461 |
| 3-174920 | 7/1991 | Japan | 72/461 |
| 3-221226 | 9/1991 | Japan | 72/461 |
| 6-31345 | 2/1994 | Japan | 72/461 |
| 69715 | 2/1994 | Japan . | |
| 798224 | 10/1995 | Japan . | |
| 8318319 | 12/1996 | Japan . | |

*Primary Examiner*—David Jones
*Attorney, Agent, or Firm*—Jordan and Hamburg

[57] ABSTRACT

A method and an apparatus for executing a bending process on a workpiece plate is provided wherein a rear edge of the workpiece plate is place in contact with stop members of a back gauge unit. Simultaneous with input of target value of bending dimensions, a controller provides drive units of the stop members with operative amounts for achieving front/rear directional positioning of the stop members and a gradient angle of a horizontal surface a stop surface corresponding to the target value. In response to the effective value of the operative amount, the drive units are activated to cause stop members to be moved to predetermined positions. After executing a trial bending of a workpiece plate, bending dimensions at two arbitrary bent portions of the processed workpiece plate are measured. When the measured values differ from the target value are input, based on the input values and the target value, the controller computes corrective values for operative amounts of the drive units in order that the stop members can correctively be positioned based on the corrective values, and executes corrective positioning of the stop members based on the calculated values.

22 Claims, 9 Drawing Sheets

BENDING METHOD AND APPARATUS FOR EFFECTING CORRECTIVE DISPLACEMENT OF A WORKPIECE

BACKGROUND OF THE INVENTION

The present invention relates in particular to a method for effecting bending of a workpiece plate by way of causing a rear-edge of the workpiece plate to bump against stop members of a back gauge unit and an apparatus for effecting the method in such a technical field applicable to a bending apparatus such as a press brake incorporating a back gauge unit.

Conventionally, a bending apparatus called a press brake is used for effecting bending of a workpiece plate such as a metal plate.

As shown in FIG. 6 and FIG. 7, a conventional press brake comprises a main press body 1 and a back gauge unit 2 disposed at the back of the main press body 1. In the main press body 1, a lower table 4 for mounting a lower mold 3 thereon and an upper table 6 for securing an upper mold 5 thereto are opposedly disposed above and below the front surface of the main press body 1. The upper table 6 is vertically movable via an interlinked drive mechanism such as an oil-pressure cylinder not shown. While the upper table 6 descends, a workpiece plate 8 disposed on the lower mold 3 is pressed into a V-shaped channel 7 of the lower mold 3 by the upper mold 5. Thus, the workpiece plate 8 is folded at a predetermined angle.

The above-referred back gauge unit 2 functions for positioning the workpiece plate 8 on the lower mold 3 in correspondence with bending degree predetermined for the workpiece plate 8. A pair of stop members 9 and 10, disposed to the left and to the right, are respectively movable in the front/rear direction A (in the depthwise direction of the main press body 1), in the horizontal direction E (in the widthwise direction of the main press body 1) and in the vertical direction C (in the height direction of the main press body 1).

The reference numeral 11, shown in FIG. 7, designates a slide guide for reciprocatably and slidably supporting the above stop members 9 and 10 in the horizontal direction E, where both ends of the slide guide 11 are respectively linked with a pair of drive mechanism 12 and 13 such as a ball screw mechanism.

The drive mechanisms 12 and 13 are respectively provided with independent drive sources such as servo motors. By operating the drive mechanism 12,13 individually to cause both ends of the slide guide 11 to be shifted in the front/rear direction, positions of the stop members 9,10 and a gradient angle $\alpha$ in a horizontal plane, defined by a front of a stop surface X, can respectively be set. The stop surface X corresponds to a surface against which a workpiece plate 8 is placed in contact. In other words, this is a virtual perpendicular plane formed by tips of the stop members 9 and 10. If the stop members were of single number, a work-supporting surface at a front edge surface of the stop member becomes the stop surface X. The gradient angle $\alpha$ specifies such a direction for causing the stop surface X to bump against a r ear edge of the workpiece plate 8. Gradient of line segment formed by the stop surface X on the vertical horizontal surface in contact with the stop surface X corresponds to the gradient angle $\alpha$.

The stop members 9 and 10 respectively have front-edge surfaces each forming a flat work-supporting surface 14. Initially, an operator securely holds a front edge portion of a workpiece plate 8 and then inserts a rear edge portion between the upper mold 5 and the lower mold 3 of the main press body 1 to cause the rear edge portion of the workpiece plate 8 to bump against work-supporting surfaces 14 of the respective stop members 9 and 10. Next, the main press body 1 is operated via a pedal means so that the workpiece plate 8 is bent.

In the case of processing a workpiece plate 8 into a folded state shown in FIG. 8, initially, reference target value B of a dimension between a rear edge 15 and a bending position 16 (this is called the "bending dimension") and reference target value $\theta$ of a bending angle for each workpiece plate 8 are respectively set. Next, the workpiece plate 8 is subject to a bending process in order that bent angles $\theta_L$ and $\theta_R$ at both end portions can correctly match the reference target value $\theta$ and bent dimensions $B_L$ and $B_R$ at both end portions also correspond to the reference target value B.

As shown in FIG. 9, the bending dimension is determined by a distance S between a blade tip 5*b* of the upper mold 5 and respective stop members 9 and 10 of the back gauge mechanism. On the other hand, as shown in FIG. 10, the bending angle is determined by input amount d generated by insertion of the upper mold 5 into the V-shaped channel of the lower mold 3, and thus, the distance S and the input amount d are respectively set in correspondence with the target values B and $\theta$ predetermined for the bending dimension and the bending angle.

The above referenced bending dimension is expressed by means of distance between contact position of the blade tip 5*b* of the upper mold 5 being abutted to the workpiece plate 8 and the rear edge 15 of the workpiece plate 8 (this is called "absolute dimension"). Further, the bending dimension is also expressed by means of external dimension B1 corresponding to distance between the rear edge 15 of the workpiece plate 8 and folded external surface 8*a* or by means of internal dimension B2 corresponding to distance between the rear edge 15 of the workpiece plate 8 and folded internal surface 8*b*. A difference between the external dimension B1 and the internal dimension B2 corresponds to the thickness of the workpiece plate 8. Generally, the external dimension B1 is greater than the absolute dimension, whereas the internal dimension B2 is smaller than the absolute dimension. However, in such a case in which the folded corner portion has a large circular arc, the internal dimension B2 may be greater than the absolute dimension.

When bending a workpiece plate 8 by operating a press brake incorporating the above structure, initially, a pair of drive mechanism 12 and 13 on both sides of the back gauge mechanism 2 are discretely driven to shift a pair of stop members 9 and 10 in the front/rear direction A, and the stop members 9 and 10 are respectively positioned to a predetermined position corresponding to target value B of the dimension predetermined for the workpiece plate 8. In the next step, the workpiece plate 8 is inserted between the upper mold 5 and the lower mold 3 to cause the rear edge 15 of the workpiece plate 8 to bump against the work-supporting flat surfaces 14 of respective stop members 9 and 10. While holding the above condition, the workpiece plate 8 is treated with a bending process.

When the stop members 9 and 10 disposed on both sides are positioned to the identical spots in the front/rear direction A, theoretically, bending dimensions $B_L$ and $B_R$ at both edge portions of the workpiece plate 8 should coincide with each other. However, if precision of the upper mold 5 is not maintained along a full length, then bending dimensions $B_L$ and $B_R$ will not be identical to each other.

The reference numeral 5*a* shown in FIG. 11 designates a reference surface for mounting the upper mold 5, where a relative positional relationship between the upper mold 5 and an upper table 6 is specified. When the upper mold 5 is secured to a bottom portion of the upper table 6, according to the reference surface 5*a*, the blade tip 5*b* of the upper mold 5 is positioned on a central line C of the upper table 6. Since the blade tip 5*b* of the upper mold 5 actually bends the workpiece plate 8, precision is required for positional relationship between the reference surface 5*a* for mounting the upper mold 5 and the blade tip 5*b*. Nevertheless, if precision of the positional relationship between the reference surface 5*a* for mounting the upper mold 5 and the blade tip 5*b* is not maintained along the full length of the upper mold 5, then bending dimensions $B_L$ and $B_R$ at both ends of the workpiece plate 8 will not coincide with each other.

Likewise, the bending dimensions $B_L$ and $B_R$ at both ends of the workpiece plate 8 do not coincide with each other in the case in which precision of positional relationship between the reference surface 5*a* shown in FIG. 11 and the back gauge unit 2 is not maintained along the full length.

Further, the back gauge unit 2 generally uses ball-screw drives functioning as the drive mechanism 12 and 13 for positioning the stop members 9 and 10 on both sides thereof, so if there is any difference in precision or performance characteristic of the ball-screw means on both sides, the bending dimensions $B_L/B_R$ at both edges of the workpiece plate 8 do not coincide with each other.

Further, if surfaces for supporting respective stop members 9 and 10 secured to the slide guide 11 are devoid of a precise finish, the stop members 9 and 10 cannot be positioned with satisfactory precision. Then, like the above case, bending dimensions $B_L/B_R$ at both edges of the workpiece plate 8 do not coincide with each other.

Since bending dimensions $B_L$ and $B_R$ at both edges of the workpiece plate 8 do not coincide with each other whenever erroneous factors cited above are generated, initially, a trial bending operation is performed on a workpiece plate 8, and then bending dimensions are measured at both edge portions. If measured values are not coincident with target values, then the operator discretely controls front/rear directional positions of respective stop members 9 and 10 by operating drive mechanism 12 and 13 on both sides. If measured values of bending dimensions on both sides are not coincident with each other, then operator will optimally shift positions of the stop members 9 and 10 in the front/rear directions A, thereby adjusting the gradient angle $\alpha$ of the horizontal surface of the front of stop surface X formed by tip portions of the stop members 9 and 10 disposed both sides.

Nevertheless, when positions of the stop members 9 and 10 on both sides are adjusted solely based on the operator's own sense, the operator incurs a greater burden from routines than is desired. Unless the operator is quite experienced, extreme difficulty is involved in execution of the above position adjustment work.

Since a satisfactory result cannot be achieved via a single adjustment, the operator is obliged to follow up with repeated adjustment operations in trial and error fashion, thus preventing improvement in efficiency of work and productivity.

SUMMARY OF THE INVENTION

The object of the invention is to readily execute adjustments needed for positioning of stop members without requiring experienced skill even when error is generated in a bending dimension of a workpiece plate because of a variety of erroneous factors thus far described.

According to an embodiment of the invention, means for accomplishing the above object comprises the following steps: a step for computing operative amounts corresponding to target values of a bending dimension applicable to each workpiece plate in the use of a plurality of drive units needed for setting a front/rear-directional position of the stop members and a gradient angle of a horizontal surface of a front of stop surfaces; a step for positioning the stop members by driving respective drive units by the computed operative amounts; a step for experimentally bending a workpiece plate by causing rear edge of the workpiece plate to bump against the positioned stop members; a step for measuring bending dimension applied to the workpiece plate experimentally being bent at two arbitrary spots; a step for computing corrective values for operative amounts of respective drive units for correcting the front/ rear directional positions of the stop members and gradient angle of the horizontal surface of the front of the stop surface by applying the above referenced measured values and the target values when any measured value of bending dimension of the workpiece plate is not identical to the target value; a step for correctively positioning the stop members by driving respective drive units by the computed corrective value; and a step for bending the workpiece plate by causing rear edge of the workpiece plate to bump against the stop members adjusted by the corrective positioning; wherein the above steps are subject to execution in the above sequence.

According to the above-described inventive method, even when an error is generated in the measured value of the bending dimension applied to an experimentally folded plate because of a variety of erroneous factors, by effect of computation using the measured values and the target value of the bending dimension, the front/rear directional position of the stop members and the gradient angle of the horizontal surface of the front of the stop surfaces are corrected.

Accordingly, in the course of executing a bending process on a workpiece plate, a bending dimension applied to the workpiece plate correctly coincides with the target value. Accordingly, no experienced skill is needed for adjustment of the stop members, thereby making it possible for an operator to easily perform adjustment work for positioning stop members.

According to an embodiment of the invention, a bending apparatus is provided, which comprises a main press body for bending each workpiece plate by applying ascending/descending operation of molds, more than one unit of stop members for contacting a rear edge of each workpiece plate, and a back gauge unit incorporating a plurality of drive units for adjusting the front/rear directional position of respective ones of the stop members and a gradient angle inside of a horizontal surface of a front of a stop surface, wherein the bending apparatus comprises; a data input means for effecting input of bending requirements including a target value of a bending dimension applicable to each workpiece plate and input of measured values of a bending dimension measured at two arbitrary spots of the workpiece plate processed by a a trial bending based on the bending requirements; an arithmetic means which, on receipt of data related to the bending requirements from the data input means, executes a first arithmetic operation for computing operative amounts of the drive units for achieving front/rear directional positioning of the stop members and a gradient angle of a horizontal surface of the front of a stop surface corresponding to the target value of a bending dimension applied to the workpiece plate, and then, on receipt of measured values related to a bending dimension of each workpiece plate measured at two arbitrary spots of the workpiece plate after the trial bending via the data input means, the arithmetic means executes a second arithmetic operation for computing corrective values of an operative amount of the respective drive units for correcting front/rear directional positioning of the stop members and the gradient of the horizontal surface of the front of the stop surface by applying the measured values and target value; and a control means for controlling positioning of the stop members by operating the drive units by the operative amounts computed via the first arithmetic operation executed by the arithmetic means and to correct positioning of the stop members by operating said drive units by the operative amounts corresponding to the corrective values computed via the second arithmetic operation executed by the arithmetic means.

According to the inventive bending apparatus based on the above structure, solely based on the input of values of the measured bending dimension of the workpiece plate at two arbitrary spots measured after the trial bending of the workpiece plate, the corrective values for the respective drive units needed for correcting front/rear directional positioning of the stop members and gradient angle of the horizontal surface of the front of the stop surface is calculated to activate operation of the drive units to correctively position the stop members. In consequence, it is possible to execute the bending process on each workpiece plate with a precise bending dimension at both ends being identical to each other by single operation.

DETAILED DESCRIPTION OF THE INVENTION

Figure 1:
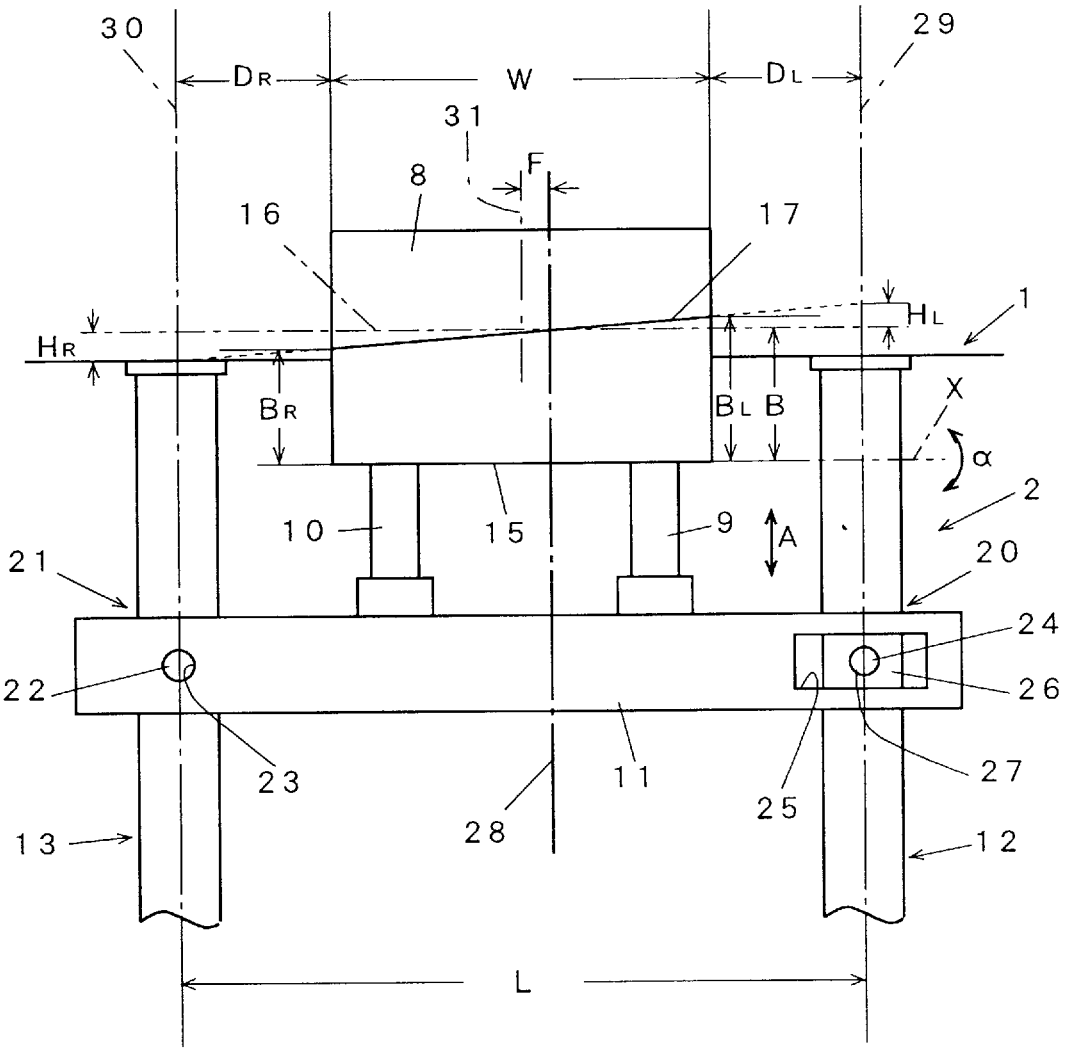
FIG. 1 is a simplified schematic plan of an embodiment of a bending apparatus of the present invention for illustrating a principle of a bending method of the present invention.
Figure 2:
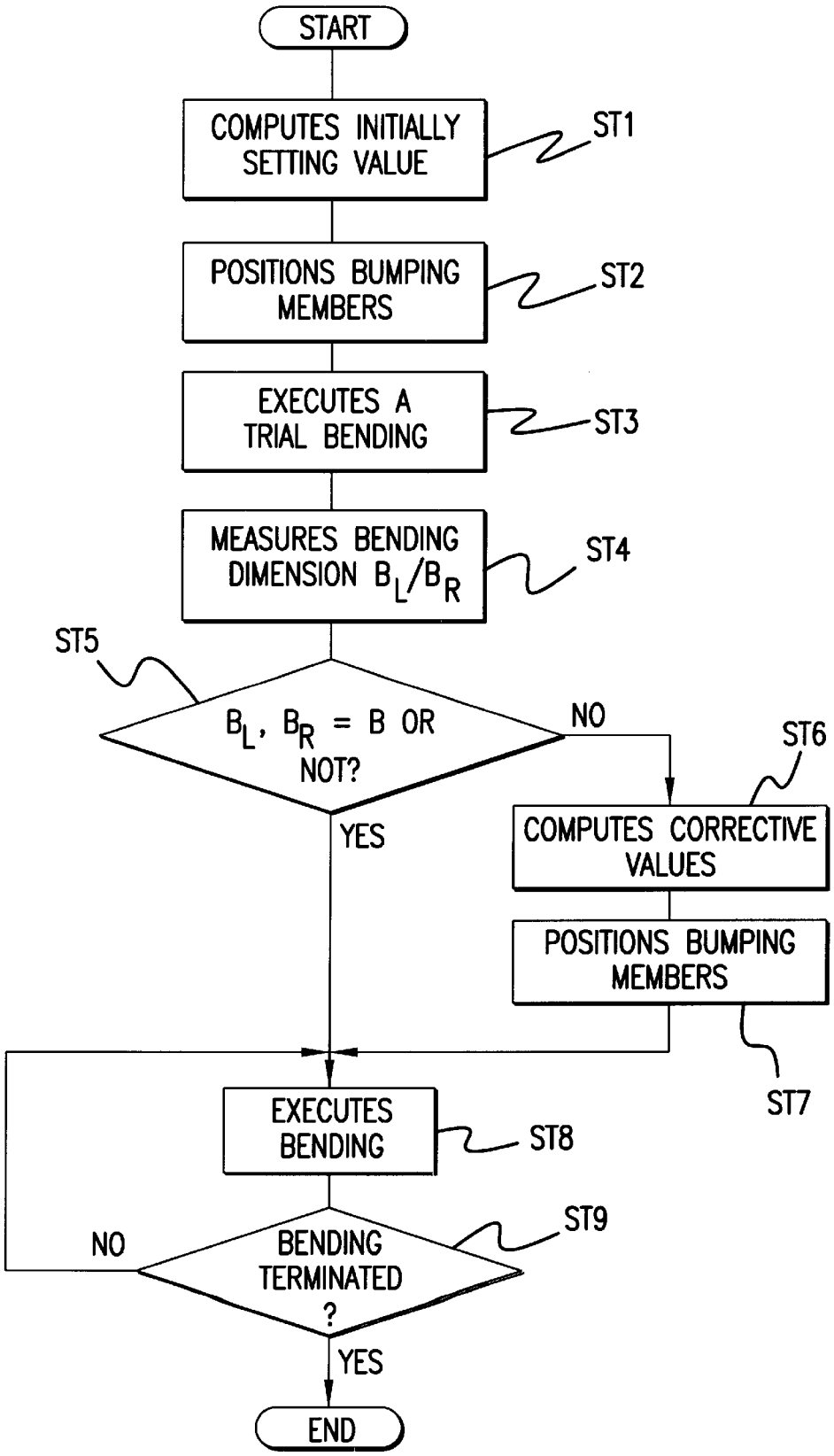
FIG. 2 is a flow chart representing sequential steps for implementing the bending method.

FIG. 1 is a simplified schematic plan of a bending apparatus for illustration of a principle of an embodiment of a bending method of the present invention. FIG. 2 is a flow chart representing sequential steps for implementing the bending process.

The bending apparatus shown in FIG. 1 represents a press brake comprising a main press body 1 and a back gauge unit 2 connected to the main press body 1. The back gauge unit 2 executes front/rear directional positioning of a workpiece plate 8, and then the main press body 1 executes a bending process on the workpiece plate 8 positioned by the back gauge unit 2 for a predetermined bending angle and bending dimension.

The back gauge unit 2 is provided with a pair of stop members 9 and 10 on both sides thereof in order that a rear edge 15 of the workpiece plate 8 can bump against them. Each of the stop members 9 and 10 is slidably held by a slide guide 11. Both ends of the slide guide 11 are respectively connected to a pair of drive units 12 and 13 respectively comprising ball-screw units.

The reference numerals 20 and 21 shown in the FIG. 1 respectively designate junctions between the slide guide 11 and respective drive units 12 and 13. Each of the junctions 20 and 21 individually drives the drive units 12 and 13 in order to optionally set front/rear directional positions of respective stop members 9 and 10 and a gradient angle of a horizontal surface of a front of a stop surface X.

The right-side junction 21, as seen from an operator view, comprises a pivotal axle 22 set above an axial core 30 of the drive unit 13 and a bearing hole 23 formed in the slide guide 11, where the pivotal axle 22 is rotatably coupled with the bearing hole 23.

The left-side junction 20, as seen from an operator view, comprises a pivotal axle 24 set above an axial core 29 of the drive unit 12, a slide channel 25 formed in the slide guide 11, and a slidable bearing 26 slidably being disposed inside of the slide channel 25, where the pivotal axle 24 is rotatably coupled with a bearing hole 27 formed in the slidable bearing 26.

The reference numeral 28 shown in FIG. 1 designates the machine center of the back gauge unit 2, where a workpiece plate 8 is positioned by way of being biased to the right from the machine center 28 by distance F as seen from the operator. Accordingly, distance $D_L$ between the axial core 29 of the left-side drive unit 12 and the left end of the workpiece plate 8 is greater than distance $D_R$ between the axial core 30 of the right-side drive unit 13 and the right end of the workpiece plate 8.

The reference numeral 16 shown in FIG. 1 designates a bendable target position for the workpiece plate 8, whereas the reference numeral 17 designates the position at which the workpiece plate 8 has actually been bent via a trial bending. In this case, bending dimension $B_L$ at the left end of the workpiece plate 8 is greater than distance between a rear end 15 of the workpiece plate 8 and the bendable target position 16, in other words, being greater than target value B of bending dimension. On the other hand, bending dimension $B_R$ at the right end of the workpiece plate 8 is smaller than the target value B thereof Referring now to FIG. 2, sequential steps of the bending process (individual steps are denoted by "ST") are described below.

Initially, operative amounts of respective drive units 12 and 13 are computed by a controller inside of the bending apparatus in order to identify actual positions of the stop members 9 and 10 in the front/rear direction A and actual gradient angle $\alpha$ (normally $\alpha$=0) inside of a horizontal surface of a front of the stop surface X by referring to bending requirements such as target value B of a bending dimension applied to a workpiece plate 8 and a width W thereof Then, by individually driving respective drive units 12 and 13 by the operative amounts, the stop members 9 and 10 are shifted to a predetermined position (ST 1 and 2).

Next, the operator executes a trial bending of a workpiece plate 8 by causing rear the edge 15 of the workpiece plate 8 to bump against respective stop members 9 and 10, and then extracts the workpiece plate 8 from the main press body 1. Next, the operator measures bending dimensions $B_L$ and $B_R$ at both ends of the workpiece plate 8 with a measuring instrument such as a vernier caliper for example (ST 3 and 4). However, if absolute dimensions are to be introduced, since a dimension cannot be measured directly with such an instrument as a vernier caliper, an external dimension is measured before being converted into the absolute dimension. Although bending dimension may be measured at two arbitrary spots, by measuring both ends of a workpiece plate 8, based on bending requirements such as width of the workpiece plate and bendable position, it is possible to specify the corresponding positions of the back gauge unit 2 to the measured positions of the workpiece plate 8, thus making it possible to execute corrective arithmetic operations thenceforth. However, if it is conceivable that any uncertain factor such as remnants may be present in edge portions of a workpiece plate 8, measurement may be applied to such portions inside from both ends by a predetermined distance. In this case, by taking a predetermined distance into account for corrective arithmetic operation, it is also possible to specify the corresponding positions of the back gauge unit 2 to the measured positions of the workpiece plate 8 and execute corrective arithmetic operation.

After executing the above measuring process in ST 4, if bending dimensions $B_L$ and $B_R$ on both sides of the workpiece plate 8 are not coincident with target value B of bending dimension or if bending dimensions $B_L$ and $B_R$ are not identical to each other, judgment in ST5 turns out to be "NO". In this case, based on actual bending dimensions $B_L$ and $B_R$ and target value B of the bending dimensions, the controller computes corrective values as operative amounts for driving respective drive units 12 and 13 to correct positions of respective stop members 9 and 10 in the front/rear direction A and gradient angle $\alpha$ and then discretely drives respective reciprocating units 12 and 13 by the corrective amounts in order that respective stop members 9 and 10 are shifted to corrected positions (ST 6 and 7).

After executing the above corrective positioning, bending of each workpiece plate 8 is repeatedly carried on by causing rear edge of each workpiece plate 8 to bump against respective stop members 9 and 10. When the judgment on ST9 turns out to be "YES", the bending process is terminated.

According to an example shown in FIG. 1, after implementing a trial bending of a workpiece plate 8 in ST3, actual bending position 17 was not coincident with bending target position 16. After measuring bending dimensions $B_L$ and $B_R$ on both ends of the workpiece plate 8 in the following ST4, bending dimension $B_L$ at the left end of the workpiece plate 8 was greater than target value B by such an amount corresponding to error ($B_L$–$B_R$), whereas bending dimension $B_R$ at the right end of the plate work 8 was smaller than target value B by such an amount corresponding to error (B–$B_R$). In the above case, gradient T at the bending position 17 of the workpiece plate 8 was given according to an expression shown below.

$$T = \frac{B_L - B_R}{W} \tag{1}$$

In order to coincide bending target position 16 with actual bending position 17 by resetting gradient T, assume that $H_L$ and $H_R$ are given to be values for correcting operative amounts of respective drive units 12 and 13 needed for correcting front/rear directional positions of respective stop members 9 and 10 and the gradient angle. In such a case in which gradient T is quite negligible, the above-quoted corrective values $H_L$ and $H_R$ may approximately be expressed according to expressions (2) and (3) shown below.

$$H_L = B - B_L - T \cdot D_L \tag{2}$$

$$H_R = B - B_R - T \cdot D_R \tag{3}$$

In the above expressions 2 and 3, $D_L$ denotes the distance between an axial core 29 of the drive unit 12 on the left side and the left end of a workpiece plate 8, whereas $D_R$ denotes the distance between an axial core 30 of the drive unit 13 on the right side and the right end of the workpiece plate 8. Assume that lateral directional bias of the workpiece plate 8 against the machine center 28, i.e., distance between the machine center 28 and the center 31 of the workpiece plate 8, is F, whereas a distance between the axial cores 29 and 30 of the drive units 12 and 13 on both sides is L and a width of the workpiece plate 8 is W, then, the above distances $D_L$ and $D_R$ can be calculated by applying expressions (4) and (5) shown below.

$$D_L = \frac{L}{2} + F - \frac{W}{2} \tag{4}$$

$$D_R = \frac{L}{2} - F - \frac{W}{2} \tag{5}$$

Accordingly, based on the above expressions (1), (4), and (5), the above expressions (2) and (3) can respectively be transformed into expressions (6) and (7) shown below.

$$H_L = B - B_L - \frac{1}{W}(B_L - B_R)\left(\frac{L}{2} + F - \frac{W}{2}\right) \tag{6}$$

$$H_R = B - B_R - \frac{1}{W}(B_L - B_R)\left(\frac{L}{2} - F - \frac{W}{2}\right) \tag{7}$$

As is clear from the above expressions (6) and (7), by applying bending dimensions $B_L$ and $B_R$ at both edges of the workpiece plate 8 generated by a trial bending process and target value B of bending dimension, the controller can compute values $H_L$ and $H_R$ for correcting driving amounts of the drive units 12 and 13 on both sides. Accordingly, by way of executing corrective positioning for respective stop members 9 and 10 by operating respective drive units 12 and 13 by corrective amounts $H_L$ and $H_R$ in the bending process performed in ST 8, the workpiece plate 8 can be treated with a bending process at the targeted bending position 16.

For convenience, the bending dimension applicable to the workpiece plate 8 has been expressed in terms of absolute distance in the above description. Nevertheless, since absolute distance on the workpiece plate 8 finished with a bending process cannot be measured in practical bending operation, generally, external dimension is measured. Even when any format of bending dimension is applied, since the above expressions (6) and (7) respectively use difference between the target value and the actually measured value or difference between actually measured values, resultant values from arithmetic operations are identical to each other.

Figure 3:
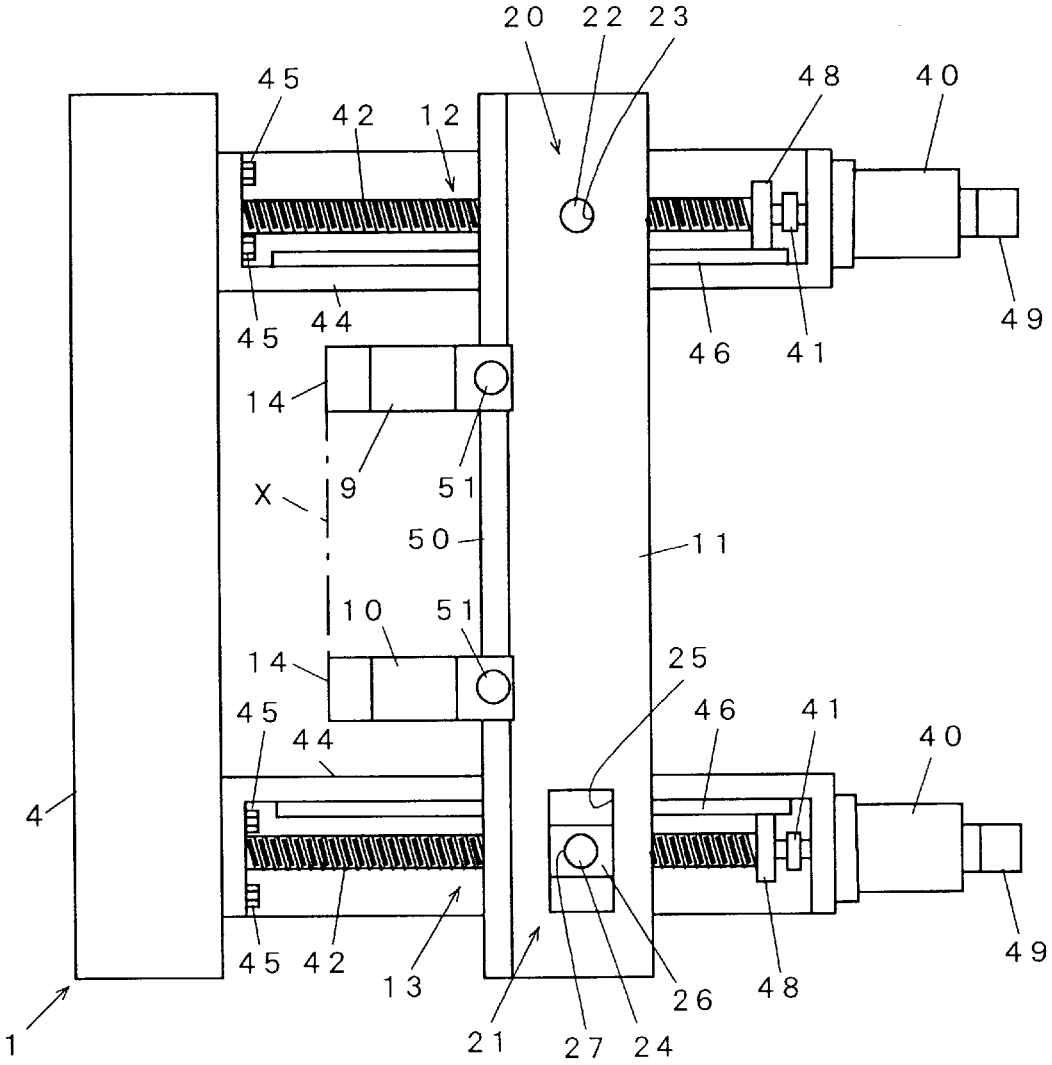
FIG. 3 is a plan of a press brake for executing the bending method.
Figure 4:
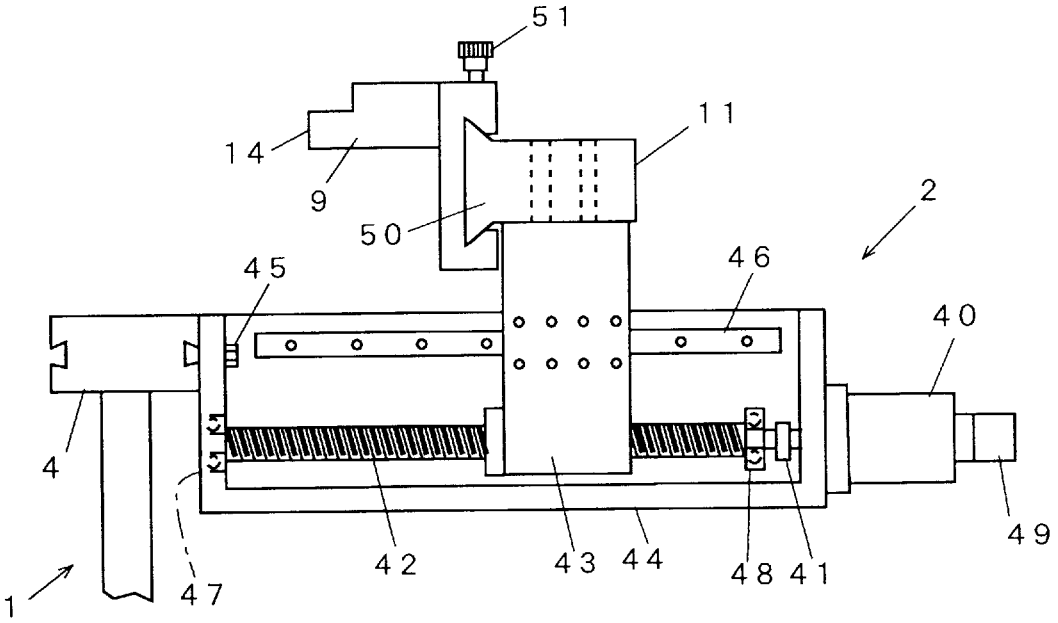
FIG. 4 is a lateral view of the press brake shown in FIG. 3.

FIG. 3 and FIG. 4 respectively illustrate an embodiment of a press brake, in particular, structure of a back gauge unit 2.

The exemplified press brake comprises a main press body 1, a back gauge unit 2, and a table 4. The back gauge unit 2 is disposed behind the main press body 1 and is linked with the table 4, secured below the main press body 1.

The back gauge unit 2 is provided with a pair of stop members 9 and 10 disposed on both sides thereof to contact the rear edge of each workpiece plate 8. The stop members 9 and 10 are slidably held by a slide guide 11 whose both ends are connected to a pair of drive units 12 and 13 respectively comprising ball-screw units via junction members 20 and 21.

Each of the drive units 12 and 13 is driven by an AC servo motor 40 for example. A movable unit 43 is coupled with a feed screw 42 which is connected to direction by causing the feed screw 42 to be axially rotated by driving the drive motor 40 in the normal and reverse directions.

Each drive motor 40 is provided with a rotary encoder 49. Based on signal output from the respective rotary encoders 49,49, operative amounts of respective drive units 12 and 13 are monitored.

The reference numeral 44, shown in FIG. 3 and FIG. 4, designates a mounting frame. A front plate of the mounting frame 44 is secured to the table 4 of the main press body 1 via bolts 45. The drive motor 40 is secured to a rear plate of the mounting frame 44. The mounting frame 44 internally accommodates the feed screw 42 linked with the drive motor 40, the movable unit 43 coupled with the feed screw 42 via screw threads, and a linear guide 46 with which the movable unit 43 is reciprocatably engaged. Both ends of the feed screw 42 are rotatably coupled with a pair of bearings 47 and 48 provided inside of the mounting frame 44.

The junction members 20 and 21 are discretely driven by the drive units 12 and 13 on both sides in order that the front/rear directional position of respective stop members 9 and 10 and the gradient angle can optionally be set. The left-side junction member 20 shown in this embodiment has such a structure in which the upwardly projecting round pivot axle 22 is provided on the movable unit 43 of the drive unit 12, while the circular bearing hole 23 is formed in the slide guide 11, thereby the round pivot axle 22 is rotatably coupled with the bearing hole 23.

The right-side junction member 21 has the upwardly projecting round pivot axle 24 provided on the movable unit 43 of the right-side drive unit 13, while the laterally extended rectangular slide channel 25 is formed in the slide guide 11, where the slide channel 25 slidably accommodates the slidable bearing 26 therein. The pivot 24 is rotatably coupled with the circular bearing hole 27 formed in the slidable bearing 26.

The slide guide 11 is provided with a guide rail 50 extending along the full length of the front surface of the slide guide 11. The stop members 9 and 10 are reciprocatably and slidably engaged with the guide rail 50, where the stop members 9 and 10 are respectively provided with a knob 51 to set the positioning.

In this embodiment, the stop members 9 and 10 are shifted via the guide rail 50 up to the desired position by manual operation. However, if only a rack is provided on the side of the slide guide 11 and a motor-driven pinion gear on the side of each stop member 9 and 10, it is possible to effect positioning of the stop members 9 and 10 by shifting them with power.

Tip portions of respective stop members 9,10 are respectively formed into the flat surface 14 for supporting a workpiece plate. The rear edge 15 of each workpiece plate 8 is forced against the supporting surfaces 14 of the stop members 9 and 10.

By causing the above referenced drive units 12 and 13 to individually shift both end portions of the slide guide 11, front/rear directional positions of the work-supporting supporting surfaces 14 of respective stop members 9 and 10 and the gradient angle of stop surfaces X formed by tip portions of respective stop members 9 and 10 can properly be adjusted.

In this embodiment, a pair of stop members 9 and 10 are provided. However, it is also permissible to provide a single number or three or more than three stop members.

If there were merely a single stop member, then, the work-supporting surface at the tip portion thereof forms the above-referred stop surface X. In this case, in place of a pair of drive units 12 and 13, a first drive unit for shifting the stop member in the front/rear direction and a second drive unit for turning direction (gradient) of the stop surface X by rotating the stop member are conjunctionally introduced.

In the case of using a pair of stop members for example, it is also permissible to combine a first drive unit for causing the stop members to simultaneously move themselves in the front/rear direction with a second drive unit for causing either of the stop members to shift in the front/rear direction.

Figure 5:
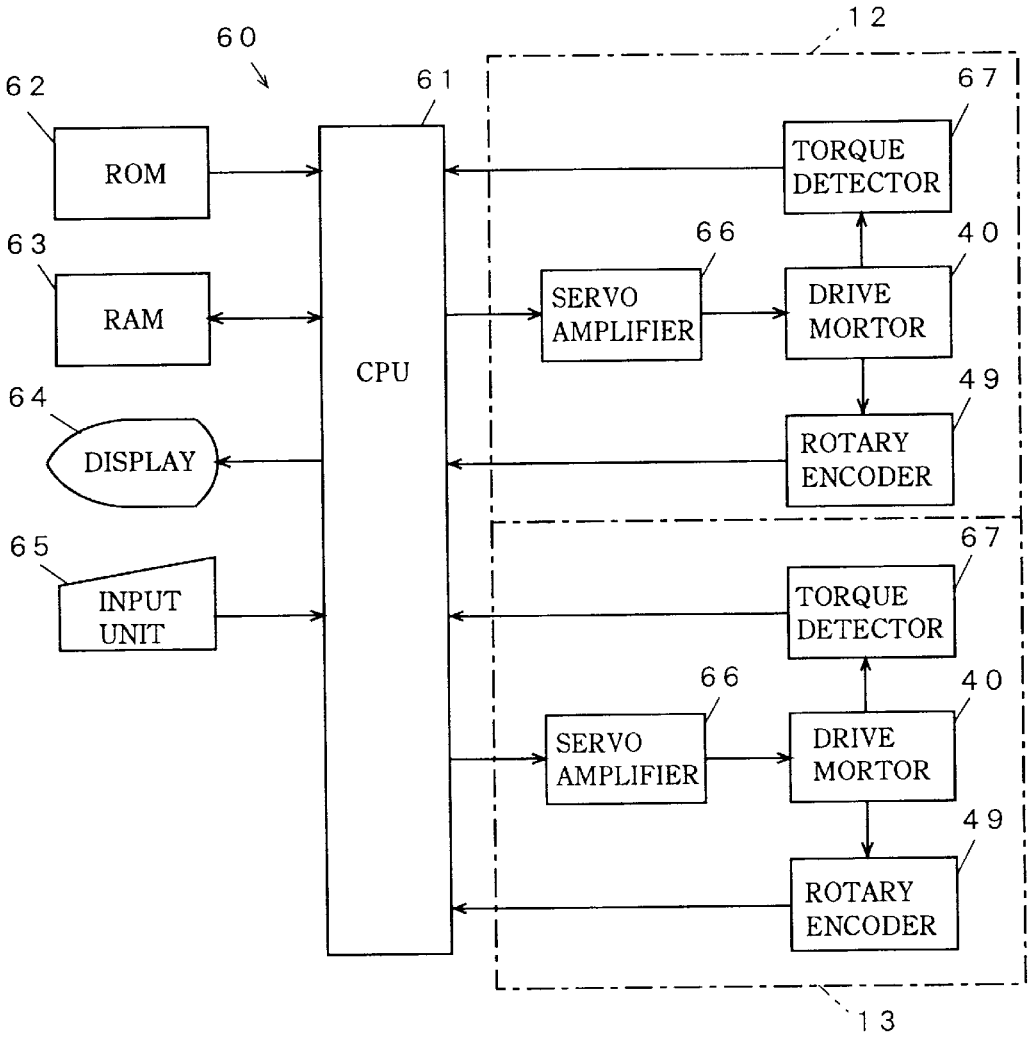
FIG. 5 is a block diagram of circuit structure of a control unit provided for the press brake shown in FIG. 3.
Figure 6:
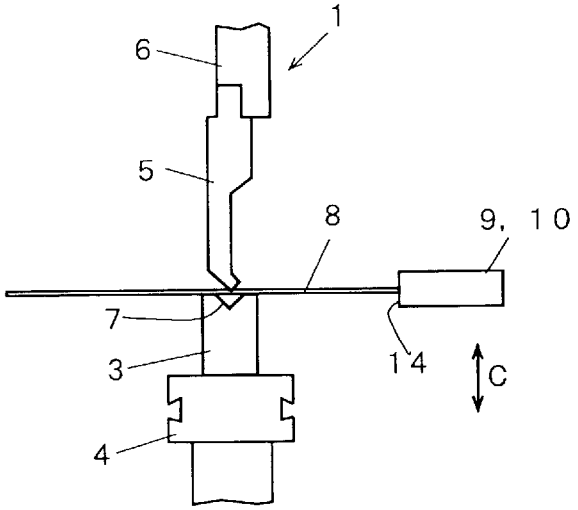
FIG. 6 is a simplified structural lateral view of a conventional press brake.
Figure 7:
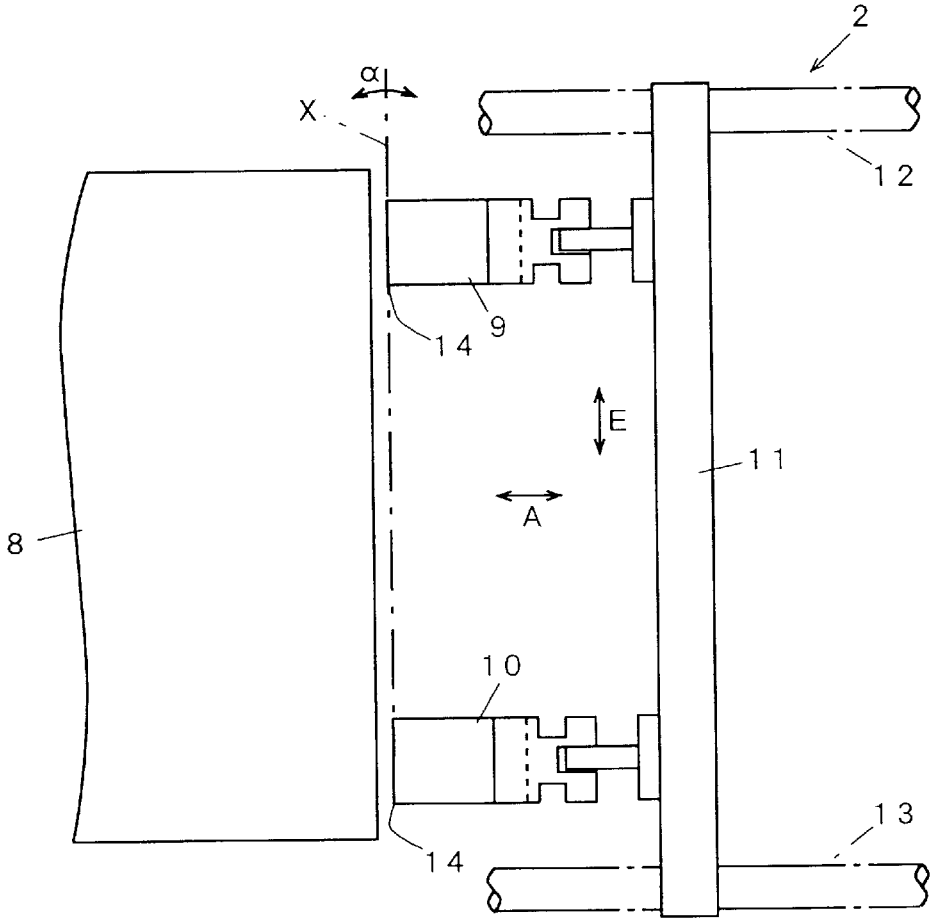
FIG. 7 is a simplified structural plan of a conventional press brake.
Figure 8:
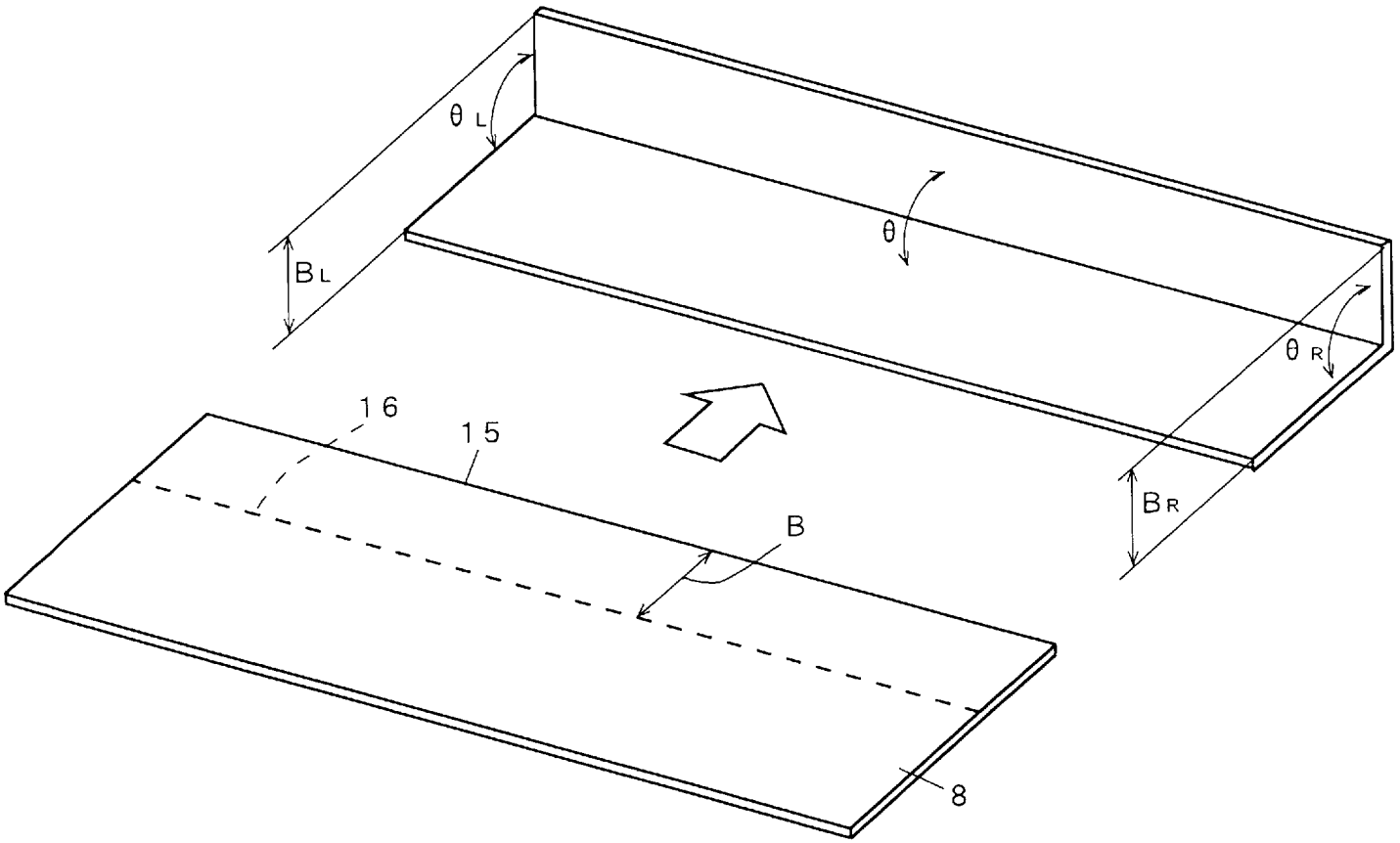
FIG. 8 is a perspective view representing a workpiece plate and a state of the workpiece plate being bent.
Figure 9:
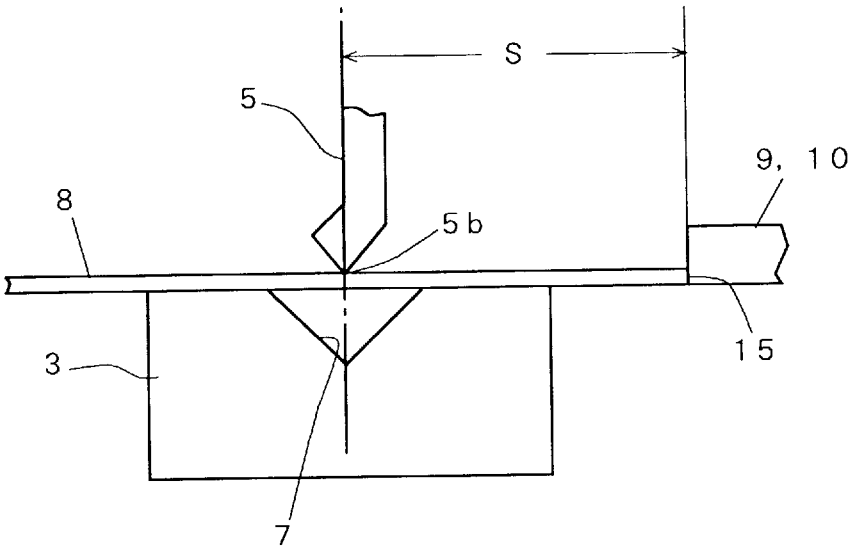
FIG. 9 is a lateral view of upper/lower molds for illustration of the method for setting a bending dimension.
Figure 10:
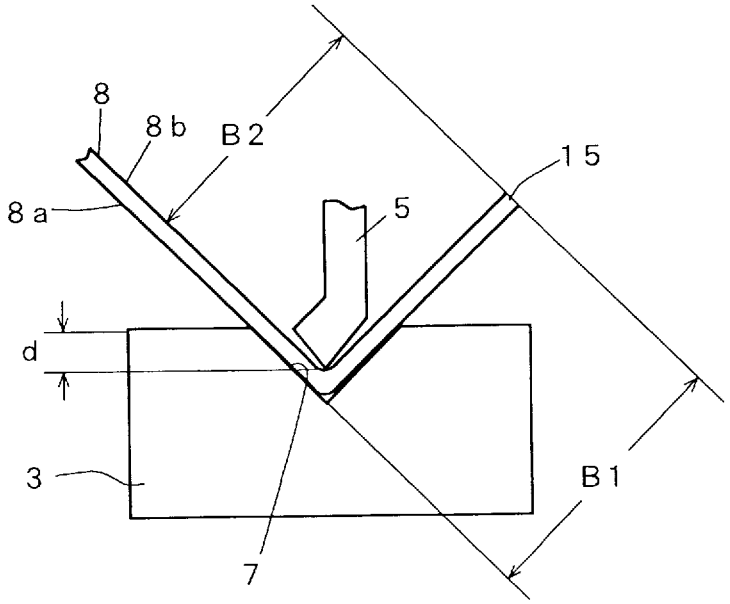
FIG. 10 is a lateral view of the upper/lower molds for illustration of the method for setting a bending angle and a concept of a bending dimension.
Figure 11:
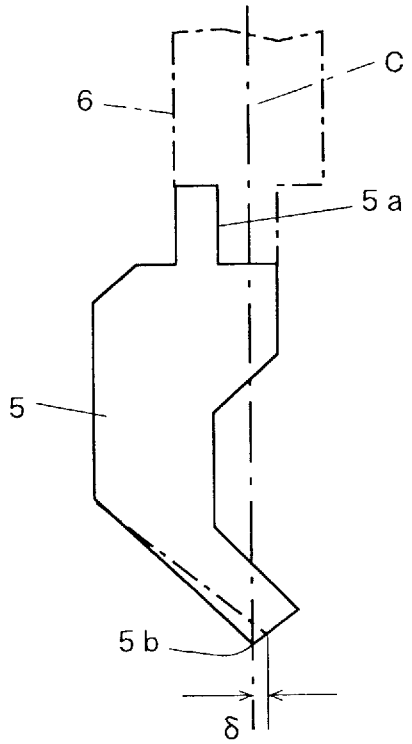
FIG. 11 is a lateral view of an upper mold for illustration of problems existing in a conventional bending method.

FIG. 5 is a schematic circuit block diagram of a control unit 60 for integrally controlling operation of the bending apparatus described above.

In FIG. 5, a CPU 61 makes up a microcomputer in conjunction with a ROM 62 and a RAM 63 in order to execute instruction analysis and a variety of arithmetic operations. The ROM 62 stores programs needed for controlling machine operation, whereas the RAM 63 stores results of arithmetic operations, user's programs, and other data.

A display 64 and an input unit 65 are respectively provided on an operation panel of a control box (not illustrated) of the press brake.

The input unit 65 comprises a variety of switches, functional keys, and numeric keys needed for mechanical operation and data input operation. Input data from the input unit 65 is displayed on the display unit 64.

The CPU 61 transmits an output signal for each of the above referenced drive motors 40,40 driving the drive units 12 and 13 via corresponding servo amplifiers 66, which then amplify the output signal before delivering it to corresponding motors 40,40. The rotary encoder 49 and a torque detector 67 are connected to each drive motor 40. The rotary encoder 49 detects an actual angle of the rotation of the corresponding motor 40, i.e., it detects an operative amount of the drive units 12 or 13, and then outputs the detected value to the CPU 61. The torque detector 67 detects actual torque of the corresponding drive motor 40 by monitoring current flowing through the motor 40.

In order to execute a process for bending a workpiece plate 8 by operating the press brake incorporating the above structure, initially, prior to execution of a bending operation, data related to bending requirements such as target value B of bending dimension applicable to each workpiece plate 8 is input via the input unit 65. Not only the target value B, but input data also includes distance F and plate-width W shown in FIG. 1. The input data is stored in the RAM 63, which also stores data on distance L needed for executing the above-referred arithmetic expressions and arithmetic operations.

On receipt of input data related to the bending requirements, the CPU 61 of the controller 60 computes actual operative amounts of respective drive units 12 and 13 needed for achieving front-rear directional positioning of the stop members 9 and 10 and the setting of the gradient angle $\alpha$ corresponding to the target value B of bending dimension applied to each workpiece plate 8, and then drives respective drive units 12 and 13 by the computed operative amounts to effect positioning of the stop members 9 and 10.

The operator then sets a workpiece plate 8 to the main press body 1, places the rear edge 15 of the workpiece plate 8 in contact with the stop members 9 and 10 before executing a trial bending of the workpiece plate 8, and then executes a trial bending of the workpiece plate 8.

After completing the trial bending process, the operator extracts the workpiece plate 8 from the main press body 1, and then measures bend dimensions $B_L$ and $B_R$ on both sides of the processed workpiece plate 8.

In the case in which measured values of bending dimensions $B_L$ and $B_R$ on both sides of the processed workpiece plate 8 are not identical to the target value B or the measured values of the bend dimensions $B_L$ and $B_R$ are not identical to each other, the operator inputs the measured values of the bend dimensions $B_L$ and $B_R$ via the input unit 65. In this embodiment, the operator inputs measured values of the bend dimensions $B_L$ and $B_R$. Not only may the measured values of the bend dimensions $B_L$ and $B_R$ be input, but the operator may also input differential values ($B_L$−B) and (B−$B_R$) between the target value B and the actually measured values.

Based on the input data, by executing arithmetic operations according to the above-referred expressions (6) and (7), the CPU 61 of the controller 60 computes values needed for correcting operative amounts of respective drive units 12 and 13 to correct front/rear directional positioning of the stop members 9 and 10 and the gradient angle, and then correctively positions the stop members 9,10 by operating the drive units 12 and 13 by the corrective amounts calculated via the above expressions.

After completing the above preliminary processes, a workpiece plate 8 is introduced to the main press body 1, the rear edge of the workpiece plate 8 is placed in contact with the stop members 9 and 10, and a bending process for bending the plate work 8 is executed.

What is claimed is:

1. A method of executing a bending process on workpiece plate comprising the steps of:

providing a press brake having a back gauge unit with a stop member means for positioning a workpiece, said stop member means defining a horizontal stop surface for engaging and positioning said workpiece plate, said stop member means having drive mechanism for positioning said horizontal stop surface relative to a bend tool of the press brake, said brake press having a controller for controlling said drive mechanism, accepting and storing at least one target bend value, accepting at least one trial bend value, and calculating an initial position and a corrective displacement;

inputting said at least one target bend value into said controller wherein said at least one target bend value indicates a position on said workpiece plate for a bend to be made by said bend tool relative to a reference edge of said workpiece plate;

operating said controller to calculate said initial position of said horizontal stop surface relative to a plane of operation of said bend tool based on said target bend value;

operating said controller to drive said drive mechanism to position said horizontal stop surface at said initial position;

placing said reference edge of said workpiece plate against said horizontal stop surface;

operating said brake press to effect a trial bend in said workpiece plate;

measuring trial bend values indicating positions of said trial bend relative to said reference edge at at least two measurement positions along said reference edge;

inputting said trial bend values into said controller;

operating said controller to calculate said corrective displacement of said horizontal stop surface to correct for differences between said trial bend values and said at least one target bend value; and operating said controller to drive said drive mechanism to displace said horizontal stop surface in accordance with said corrective displacement.

2. The method of claim 1 wherein:

said horizontal stop surface has a horizontal stop surface left end and a horizontal stop surface right end;

said drive mechanism includes a left drive means, operating on a left axis, for displacing said horizontal stop surface left end in a first direction perpendicular to a longitudinal bend direction of said bend tool;

said drive mechanism includes a right drive means, operating on a right axis, for displacing said horizontal stop surface right end in said first direction;

said drive mechanism includes means for operating said left drive means and said right drive means to effect differing displacements for rotating said horizontal stop surface relative to a longitudinal bend direction of said bend tool to vary a gradient angle defined by an orientation of said horizontal stop surface relative to said longitudinal bend direction; and said corrective displacement includes a displacement of said horizontal stop surface along said first direction and rotational displacement of said horizontal stop surface varying said gradient angle.

3. The method of claim 2 wherein:

said step of operating said controller to calculate said corrective displacement includes said controller performing the following steps:

calculating a value T of said gradient angle using a first equation, $$T = \frac{B_L - B_R}{W},$$

wherein W is a width of said workpiece plate, $B_L$ and $B_R$ are said trial bend values respectively corresponding to a left end trial bend value and a right end trial bend value and said at least two measurement positions along said reference edge are positions at a left end and a right end of said workpiece plate;

calculating a corrective displacement $H_L$ for said horizontal stop surface left end using a second equation, $$H_L = B - {}_L - T \cdot D_L,$$

wherein B is said target bend value and $D_L$ is a distance from said left end of said workpiece plate to said left axis of said left drive means; and calculating a corrective displacement $H_R$ for said horizontal stop surface right end using a third equation, $$H_R = B - B_R - T \cdot D_R,$$

wherein $D_R$ is a distance from said right end of said workpiece plate to said right axis of said right drive means; and said step of operating said controller to drive said drive mechanism to displace said horizontal stop surface in accordance with said corrective displacement includes:

operating said controller to drive said left drive means to displace said horizontal stop surface left end in accordance with said corrective displacement $H_L$; and operating said controller to drive said right drive means to displace said horizontal stop surface right end in accordance with said corrective displacement $H_R$.

4. The method of claim 1 wherein:

said horizontal stop surface has a horizontal stop surface left end and a horizontal stop surface right end;

said drive mechanism includes:

a left drive means for displacing said horizontal stop surface left end along a left axis in a first direction perpendicular to a longitudinal bend direction of said bend tool;

a right drive means for displacing said horizontal stop surface right end along a right axis in said first direction; and means for operating said left drive means and said right drive means to effect differing displacements for rotating said horizontal stop surface relative to said longitudinal bend direction to vary a gradient angle defined by an orientation of said horizontal stop surface relative to said longitudinal bend direction;

said corrective displacement includes a displacement of said horizontal stop surface along said first direction and rotational displacement of said horizontal stop surface varying said gradient angle;

said step of measuring said trial bend values includes measuring a left end trial bend value $B_L$ and a right end trial bend value $B_R$ wherein said at least two measurement positions are respectively at a left end and a right end of said workpiece plate;

said step of operating said controller to calculate said corrective displacement includes said controller performing the following steps:

calculating a corrective displacement $H_L$ for said horizontal stop surface left end in accordance with a first equation, $$H_L = B - B_L - \frac{1}{W}(B_L - B_R)\left(\frac{L}{2} + F - \frac{W}{2}\right),$$

and calculating a corrective displacement $H_R$ for said horizontal stop surface right end in accordance with a second equation, $$H_R = B - B_R - \frac{1}{W}(B_L - B_R)\left(\frac{L}{2} - F - \frac{W}{2}\right),$$

wherein W is a width of said workpiece plate, B is said target bend value, L is a distance between said left axis and said right axis, and F is an offset distance between a center of the workpiece plate and center between said left axis and said right axis; and said step of operating said controller to drive said drive mechanism to displace said horizontal stop surface in accordance with said corrective displacement includes:

operating said controller to drive said left drive means to displace said horizontal stop surface left end in accordance with said corrective displacement $H_L$; and operating said controller to drive said right drive means to displace said horizontal stop surface right end in accordance with said corrective displacement $H_R$.

5. The method of claim 1 wherein:

said horizontal stop surface has a horizontal stop surface left end and a horizontal stop surface right end;

said drive mechanism includes:

a left drive means for displacing said horizontal stop surface left end along a left axis in a first direction perpendicular to a longitudinal bend direction of said bend tool;

a right drive means for displacing said horizontal stop surface right end along a right axis in said first direction; and means for operating said left drive means and said right drive means to effect differing displacements for rotating said horizontal stop surface relative to said longitudinal bend direction to vary a gradient angle defined by an orientation of said horizontal stop surface relative to said longitudinal bend direction;

said corrective displacement includes a displacement of said horizontal stop surface along said first direction and rotational displacement of said horizontal stop surface varying said gradient angle;

said step of measuring said trial bend values includes measuring a left trial bend value $B_L$ and a right trial bend value $B_R$ wherein said at least two measurement positions are respectively at a left position and a right position on said workpiece plate;

said step of operating said controller to calculate said corrective displacement includes said controller performing the following steps:

calculating a value T of said gradient angle using a first equation, $$T = \frac{B_L - B_R}{W},$$

wherein W is a distance between said left position and said right position on said workpiece plate;

calculating a corrective displacement $H_L$ for said horizontal stop surface left end using a second equation, $$H_L = B - B_L - T \cdot D_L,$$

wherein B is said target bend value and $D_L$ is a distance from said left position to said left axis of said left drive means; and calculating a corrective displacement $H_R$ for said horizontal stop surface right end using a third equation, $$H_R = B - B_R - T \cdot D_R,$$

wherein $D_R$ is a distance from said right position to said right axis of said right drive means; and said step of operating said controller to drive said drive mechanism to displace said horizontal stop surface in accordance with said corrective displacement includes:

operating said controller to drive said left drive means to displace said horizontal stop surface left end in accordance with said corrective displacement $H_L$; and operating said controller to drive said right drive means to displace said horizontal stop surface right end in accordance with said corrective displacement $H_R$.

6. The method of claim 1 wherein:

said horizontal stop surface has a horizontal stop surface left end and a horizontal stop surface right end;

said drive mechanism includes:

a left drive means for displacing said horizontal stop surface left end along a left axis in a first direction perpendicular to a longitudinal bend direction of said bend tool;

a right drive means for displacing said horizontal stop surface right end along a right axis in said first direction; and means for operating said left drive means and said right drive means to effect differing displacements for rotating said horizontal stop surface relative to said longitudinal bend direction to vary a gradient angle defined by an orientation of said horizontal stop surface relative to said longitudinal bend direction;

said corrective displacement includes a displacement of said horizontal stop surface along said first direction and rotational displacement of said horizontal stop surface varying said gradient angle;

said step of measuring said trial bend values includes measuring a left trial bend value $B_L$ and a right trial bend value $B_R$ wherein said at least two measurement positions are respectively at a left position and a right position on said workpiece plate;

said step of operating said controller to calculate said corrective displacement includes said controller performing the following steps:

calculating a corrective displacement $H_L$ for said left drive means in accordance with a first equation, $$H_L = B - B_L - \frac{1}{W}(B_L - B_R)\left(\frac{L}{2} + F - \frac{W}{2}\right),$$

and calculating a corrective displacement $H_R$ for said right drive means in accordance with a second equation, $$H_R = B - B_R - \frac{1}{W}(B_L - B_R)\left(\frac{L}{2} - F - \frac{W}{2}\right),$$

wherein W is a distance between said left position and said right position on said workpiece plate, B is said target bend value, L is a distance between said left axis and said right axis, and F is an offset distance between a center between said left position and said right position on the workpiece plate and a center between said left axis and said right axis; and said step of operating said controller to drive said drive mechanism to displace said horizontal stop surface in accordance with said corrective displacement includes:

operating said controller to drive said left drive means to displace said horizontal stop surface left end in accordance with said corrective displacement $H_L$; and operating said controller to drive said right drive means to displace said horizontal stop surface right end in accordance with said corrective displacement $H_R$.

7. The method of claim 1 wherein:

said drive mechanism effects displacement of said horizontal stop surface in a said first direction perpendicular to a longitudinal bend direction of said bend tool and rotational displacement of said horizontal stop surface varying a gradient angle defined by an orientation of said horizontal stop surface relative to said longitudinal bend direction; and said corrective displacement includes displacement of said horizontal stop surface in said first direction and rotational displacement of said horizontal stop surface varying said gradient angle.

8. The method of claim 7 wherein:

said step of measuring said trial bend values includes measuring a left trial bend value $B_L$ and a right trial bend value $B_R$ wherein said at least two measurement positions are respectively at a left position and a right position on said workpiece plate;

said step of operating said controller to calculate said corrective displacement includes calculating a value T of said gradient angle using an equation, $$T = \frac{B_L - B_R}{W},$$

wherein W is a distance between said left position and said right position on said workpiece plate; and said step of operating said controller to drive said drive mechanism to displace said horizontal stop surface in accordance with said corrective displacement includes rotating said horizontal stop surface to compensate said gradient angle in accordance with the value T.

9. The method of claim 7 wherein:

said horizontal stop surface has a horizontal stop surface left end and a horizontal stop surface right end; and said drive mechanism includes:

a left drive means for displacing said horizontal stop surface left end along a left axis in a first direction perpendicular to a longitudinal bend direction of said bend tool;

a right drive means for displacing said horizontal stop surface right end along a right axis in said first direction; and means for operating said left drive means and said right drive means to effect differing displacements for rotating said horizontal stop surface relative to said longitudinal bend direction to vary a gradient angle defined by an orientation of said horizontal stop surface relative to said longitudinal bend direction.

10. A method of executing a bending process on workpiece plate comprising the steps of:

providing a press brake having:

a back gauge unit with a stop member means for positioning a workpiece, said stop member means defining a horizontal stop surface for engaging and positioning said workpiece plate, said horizontal stop surface having a horizontal stop surface left end and a horizontal stop surface right end;

said stop member means having a drive mechanism for positioning said horizontal stop surface relative to a bend tool of the press brake;

said drive mechanism including:

a left drive means for displacing said horizontal stop surface left end along a left axis in a first direction perpendicular to a longitudinal bend direction of said bend tool;

a right drive means for displacing said horizontal stop surface right end along a right axis in said first direction; and means for operating said left drive means and said right drive means to effect differing displacements for rotating said horizontal stop surface relative to said longitudinal bend direction to vary a gradient angle defined by an orientation of said horizontal stop surface relative to said longitudinal bend direction; and a controller for controlling said drive mechanism, accepting and storing a target bend value, accepting trial bend values, and calculating position correction data;

inputting said target bend value into said controller wherein said target bend value indicates a position on said workpiece plate for a bend to be made by said bend tool relative to a reference edge of said workpiece plate;

operating said controller to calculate an initial position of said horizontal stop surface relative to a plane of operation of said bend tool based on said target bend value;

operating said controller to drive said drive mechanism to position said horizontal stop surface at said initial position by operation of said drive mechanism;

placing said reference edge of said workpiece plate against said horizontal stop surface;

operating said brake press to effect a trial bend in said workpiece plate;

measuring a left end trial bend value $B_L$ of a distance from said trial bend to said reference edge at a left end position of said reference edge;

measuring a right end trial bend value $B_R$ of a distance from said trial bend to said reference edge at a right end position of said reference edge;

inputting said left end trial bend value $B_L$ and said right end trial bend value $B_R$ into said controller;

operating said controller to calculate a corrective displacement of said horizontal stop surface to correct for differences between said target bend value and respective ones of said left end trial bend value $B_L$ and said right end trial bend value $B_R$ by performing the following steps:

calculating a value T of said gradient angle using a first equation, $$T = \frac{B_L - B_R}{W},$$

wherein W is a width of said workpiece plate;

calculating a corrective displacement $H_L$ for said left means using a second equation, $$H_L = B - B_L - T \cdot D_L,$$

wherein B is said target bend value and $D_L$ is a distance from said left end of said workpiece plate to said left axis of said left drive means; and calculating a corrective displacement $H_R$ for said right drive means using a third equation, $$H_R = B - B_R - T \cdot D_R,$$

wherein $D_R$ is a distance from said right end of said workpiece plate to said right axis of said right drive means;

operating said controller to drive said left drive means to displace said horizontal stop surface left end in accordance with said corrective displacement $H_1$; and operating said controller to drive said right drive means to displace said horizontal stop surface right end in accordance with said corrective displacement $H_R$.

11. A method of executing a bending process on workpiece plate comprising the steps of:

providing a press brake having:

a back gauge unit with a stop member means for positioning a workpiece, said stop member means defining a horizontal stop surface for engaging and positioning said workpiece plate, said horizontal stop surface having a horizontal stop surface left end and a horizontal stop surface right end;

said stop member means having a drive mechanism for positioning said horizontal stop surface relative to a bend tool of the press brake;

said drive mechanism including:

a left drive means for displacing said horizontal stop surface left end along a left axis in a first direction perpendicular to a longitudinal bend direction of said bend tool;

a right drive means for displacing said horizontal stop surface right end along a right axis in said first direction; and means for operating said left drive mechanism and said right drive means to effect differing displacements for rotating said horizontal stop surface relative to said longitudinal bend direction to vary a gradient angle defined by an orientation of said horizontal stop surface relative to said longitudinal bend direction; and a controller for controlling said drive mechanism, accepting and storing a target bend value, accepting trial bend values, and calculating position correction data;

inputting said target bend value into said controller wherein said target bend value indicates a position on said workpiece plate for a bend to be made by said bend tool relative to a reference edge of said workpiece plate;

operating said controller to calculate an initial position of said horizontal stop surface relative to a plane of operation of said bend tool;

operating said controller to drive said drive mechanism to position said horizontal stop surface at said initial position by operation of said drive mechanism;

placing said reference edge of said workpiece plate against said horizontal stop surface;

operating said brake press to effect a trial bend in said workpiece plate;

measuring a left end trial bend value $B_L$ of a distance from said trial bend to said reference edge at a left end position of said reference edge;

measuring a right end trial bend value $B_R$ of a distance from said trial bend to said reference edge at a right end position of said reference edge;

inputting said left end trial bend value $B_L$ and said right end trial bend value $B_R$ into said controller;

operating said controller to calculate a corrective displacement of said horizontal stop surface to correct for differences between said target bend value and respective ones of said left end trial bend value $B_L$ and said right end trial bend value $B_R$ by performing the following steps:

calculating a corrective displacement $H_L$ for said horizontal stop surface left end in accordance with a first equation, $$H_L = B - B_L - \frac{1}{W}(B_L - B_R)\left(\frac{L}{2} + F - \frac{W}{2}\right),$$

calculating a corrective displacement $H_R$ for said horizontal stop surface right end in accordance with a second equation, $$H_R = B - B_R - \frac{1}{W}(B_L - B_R)\left(\frac{L}{2} - F - \frac{W}{2}\right),$$

wherein W is a width of said workpiece plate, B is said target bend value, L is a distance between said left axis and said right axis, and F is an offset distance between a center of the workpiece plate and center between said left axis and said right axis;

operating said controller to drive said left drive means to displace said horizontal stop surface left end in accordance with said corrective displacement $H_1$; and operating said controller to drive said right drive means to displace said horizontal stop surface right end in accordance with said corrective displacement $H_R$.

12. An apparatus for bending a workpiece plate comprising:

a press brake having a back gauge unit with a stop member means for positioning a workpiece, and a bend tool;

said stop member means defining a horizontal stop surface for engaging and positioning a reference edge of said workpiece plate;

a drive mechanism for positioning said stop member means to move said horizontal stop surface relative to said bend tool;

said brake press having a controller for controlling said drive mechanism, accepting and storing a target bend value indicating a position on said workpiece plate for a bend to be made by said bend tool relative to said reference edge of said workpiece plate, and for accepting trial bend values indicating measured positions of a trial bend relative to said reference edge at at least two measurement positions along said reference edge;

said controller being configured to calculate an initial position of said horizontal stop surface relative to a plane of operation of said bend tool based on said target bend value and to drive said drive mechanism to position said horizontal stop surface at said initial position; and said controller being configured to calculate a corrective displacement of said horizontal stop surface to correct for differences between said trial bend values and said target bend value and to drive said drive mechanism to displace said horizontal stop surface in accordance with said corrective displacement.

13. The apparatus of claim 12 wherein:

said horizontal stop surface has a horizontal stop surface left end and a horizontal stop surface right end;

said drive mechanism includes a left drive means, operating on a left axis, for displacing said horizontal stop surface left end in a first direction perpendicular to a longitudinal bend direction of said bend tool;

said drive mechanism includes a right drive means, operating on a right axis, for displacing said horizontal stop surface right end in said first direction;

said drive mechanism includes means for operating said left drive means and said right drive means to effect differing displacements for rotating said horizontal stop surface relative to a longitudinal bend direction of said bend tool to vary a gradient angle defined by an orientation of said horizontal stop surface relative to said longitudinal bend direction; and said corrective displacement includes a displacement of said horizontal stop surface along said first direction and rotational displacement of said horizontal stop surface varying said gradient angle.

14. The apparatus of claim 13 wherein:

said controller being configured to calculate said corrective displacement includes said controller having means for:

calculating a value T of said gradient angle using a first equation, $$T = \frac{B_L - B_R}{W},$$

wherein W is a width of said workpiece plate, $B_L$ and $B_R$ are said trial bend values respectively corresponding to a left end trial bend value and a right end trial bend value and said at least two measurement positions along said reference edge are positions respectively at a left end and a right end of said workpiece plate;

calculating a corrective displacement $H_L$ for said horizontal stop surface left end using a second equation, $$H_L = B - B_L - T \cdot D_L,$$

wherein B is said target bend value and $D_L$ is a distance from said left end of said workpiece plate to said left axis of said left drive means; and calculating a corrective displacement $H_R$ for said horizontal stop surface right end using a third equation, $$H_R = B - B_R - T \cdot D_R,$$

wherein $D_R$ is a distance from said right end of said workpiece plate to said right axis of said right drive means; and said controller being configured to drive said drive mechanism to displace said horizontal stop surface in accordance with said corrective displacement includes:

said controller having means for driving said left drive means to displace said horizontal stop surface left end in accordance with said corrective displacement $H_L$; and said controller having means for driving said right drive means to displace said horizontal stop surface right end in accordance with said corrective displacement $H_R$.

15. The apparatus of claim 12 wherein:

said horizontal stop surface has a horizontal stop surface left end and a horizontal stop surface right end;

said drive mechanism includes:

a left drive means for displacing said horizontal stop surface left end along a left axis in a first direction perpendicular to a longitudinal bend direction of said bend tool;

a right drive means for displacing said horizontal stop surface right end along a right axis in said first direction; and means for operating said left drive means and said right drive means to effect differing displacements for rotating said horizontal stop surface relative to said longitudinal bend direction to vary a gradient angle defined by an orientation of said horizontal stop surface relative to said longitudinal bend direction;

said corrective displacement includes a displacement of said horizontal stop surface along said first direction and rotational displacement of said horizontal stop surface varying said gradient angle;

said controller being configured to calculate said corrective displacement includes instructing said controller having means for:

calculating a corrective displacement $H_L$ for said horizontal stop surface left end in accordance with a first equation, $$H_L = B - B_L - \frac{1}{W}(B_L - B_R)\left(\frac{L}{2} + F - \frac{W}{2}\right),$$

calculating a corrective displacement $H_R$ for said horizontal stop surface right end in accordance with a second equation, $$H_R = B - B_R - \frac{1}{W}(B_L - B_R)\left(\frac{L}{2} - F - \frac{W}{2}\right),$$

wherein W is a width of said workpiece plate, B is said target bend value, L is a distance between said left axis and said right axis, and F is an offset distance between a center of the workpiece plate and center between said left axis and said right axis, and $B_L$ is a left end trial bend value and $B_R$ is a right end trial bend value and said at least two measurement positions are respectively at a left end and a right end of said workpiece plate; and said controller being configured to drive said drive mechanism to displace said horizontal stop surface in accordance with said corrective displacement includes said controller having:

means for driving said left drive means to displace said horizontal stop surface left end in accordance with said corrective displacement $H_L$; and means for driving said right drive means to displace said horizontal stop surface right end in accordance with said corrective displacement $H_R$.

16. The apparatus of claim 12 wherein:

said horizontal stop surface has a horizontal stop surface left end and a horizontal stop surface right end;

said drive mechanism includes:

a left drive means for displacing said horizontal stop surface left end along a left axis in a first direction perpendicular to a longitudinal bend direction of said bend tool;

a right drive means for displacing said horizontal stop surface right end along a right axis in said first direction; and means for operating said left drive means and said right drive means to effect differing displacements for rotating said horizontal stop surface relative to said longitudinal bend direction to vary a gradient angle defined by an orientation of said horizontal stop surface relative to said longitudinal bend direction;

said corrective displacement includes a displacement of said horizontal stop surface along said first direction and rotational displacement of said horizontal stop surface varying said gradient angle;

said controller being configured to calculate said corrective displacement includes said controller having means for:

calculating a value T of said gradient angle using a first equation, $$T = \frac{B_L - B_R}{W},$$

wherein $B_L$ is a left trial bend value and $B_R$ a right trial bend value and said at least two measurement positions are respectively at a left position and a right position on said workpiece plate, and W is a distance between said left position and said right position on said workpiece plate;

calculating a corrective displacement $H_L$ for said horizontal stop surface left end using a second equation, $$H_L = B - B_L - T \cdot D_L,$$

wherein B is said target bend value and $D_L$ is a distance from said left position to said left axis of said left drive means; and calculating a corrective displacement $H_R$ for said horizontal stop surface right end using a third equation, $$H_R = B - B_R - T \cdot D_R,$$

wherein $D_R$ is a distance from said right position to said right axis of said right drive means; and said controller being configured to drive said drive mechanism to displace said horizontal stop surface in accordance with said corrective displacement includes:

said controller having means for driving said left drive means to displace said horizontal stop surface left end in accordance with said corrective displacement $H_L$; and said controller having means for driving said right drive means to displace said horizontal stop surface right end in accordance with said corrective displacement $H_R$.

17. The apparatus of claim 12 wherein:

said horizontal stop surface has a horizontal stop surface left end and a horizontal stop surface right end;

said drive mechanism includes:

a left drive means for displacing said horizontal stop surface left end along a left axis in a first direction perpendicular to a longitudinal bend direction of said bend tool;

a right drive means for displacing said horizontal stop surface right end along a right axis in said first direction; and means for operating said left drive means and said right drive means to effect differing displacements for rotating said horizontal stop surface relative to said longitudinal bend direction to vary a gradient angle defined by an orientation of said horizontal stop surface relative to said longitudinal bend direction;

said corrective displacement includes a displacement of said horizontal stop surface along said first direction and rotational displacement of said horizontal stop surface varying said gradient angle;

said controller being configured to calculate said corrective displacement includes said controller having means for:

calculating a corrective displacement $H_L$ for said left drive means in accordance with $$H_L = B - B_L - \frac{1}{W}(B_L - B_R)\left(\frac{L}{2} + F - \frac{W}{2}\right)$$

and calculating a corrective displacement $H_R$ for said right drive means in accordance with $$H_R = B - B_R - \frac{1}{W}(B_L - B_R)\left(\frac{L}{2} - F - \frac{W}{2}\right)$$

$B_L$ is a left trial bend value and $B_R$ is a right trial bend value said at least two measurement positions are respectively at a left position and a right position on said workpiece plate, W is a distance between said left position and said right position on said workpiece plate, B is said target bend value, L is a distance between said left axis and said right axis, and F is an offset distance between a center between said left position and said right position on the workpiece plate and a center between said left axis and said right axis; and said controller being configured to drive said drive mechanism to displace said horizontal stop surface in accordance with said corrective displacement includes said controller having:

means for driving said left drive means to displace said horizontal stop surface left end in accordance with said corrective displacement $H_L$; and means for driving said right drive means to displace said horizontal stop surface right end in accordance with said corrective displacement $H_R$.

18. The apparatus of claim 12 wherein:

said drive mechanism effects displacement of said horizontal stop surface in a first direction perpendicular to a longitudinal bend direction of said bend tool and rotational displacement of said horizontal stop surface varying a gradient angle defined by an orientation of said horizontal stop surface relative to said longitudinal bend direction; and said corrective displacement includes displacement of said horizontal stop surface in said first direction and rotational displacement of said horizontal stop surface varying said gradient angle.

19. The apparatus of claim 18 wherein:

said controller being configured to calculate said corrective displacement includes said controller having means for calculating a value T of said gradient angle using an equation, $$T = \frac{B_L - B_R}{W},$$

wherein $B_L$ is a left trial bend value and $B_R$ is a right trial bend value and said at least two measurement positions are respectively at a left position and a right position on said workpiece plate, and W is a distance between said left position and said right position on said workpiece plate; and said controller includes means for driving said drive mechanism to displace said horizontal stop surface in accordance with said corrective displacement to rotate said horizontal stop surface to compensate said gradient angle in accordance with the value T.

20. The apparatus of claim 18 wherein:

said horizontal stop surface has a horizontal stop surface left end and a horizontal stop surface right end; and said drive mechanism includes:

a left drive means for displacing said horizontal stop surface left end along a left axis in said first direction perpendicular to a longitudinal bend direction of said bend tool;

a right drive means for displacing said horizontal stop surface right end along a right axis in said first direction; and means for operating said left drive means and said right drive means to effect differing displacements for rotating said horizontal stop surface relative to said longitudinal bend direction to vary said gradient angle.

21. An apparatus for bending a workpiece plate comprising:

a press brake having a back gauge unit with a stop member means for positioning a workpiece and a bend tool;

said stop member means defining a horizontal stop surface for engaging and positioning a reference edge of said workpiece plate, said horizontal stop surface having a horizontal stop surface left end and a horizontal stop surface right end;

a drive mechanism for positioning said stop member means to move said horizontal stop surface relative to said bend tool, said drive mechanism including:

a left drive means for displacing said horizontal stop surface left end along a left axis in a first direction perpendicular to a longitudinal bend direction of said bend tool;

a right drive means for displacing said horizontal stop surface right end along a right axis in said first direction; and means for operating said left drive means and said right drive means to effect differing displacements for rotating said horizontal stop surface relative to said longitudinal bend direction to vary a gradient angle defined by an orientation of said horizontal stop surface relative to said longitudinal bend direction;

said brake press having a controller for controlling said drive mechanism, accepting and storing a target bend value indicating a position on said workpiece plate for a bend to be made by said bend tool relative to said reference edge of said workpiece plate, and for accepting trial bend values indicating measured positions of a trial bend relative to said reference edge at at least two measurement positions along said reference edge;

said controller being configured to calculate an initial position of said horizontal stop surface relative to a plane of operation of said bend tool based on said target bend value and to drive said drive mechanism to position said horizontal stop surface at said initial position;

said controller being configured to calculate a corrective displacement including said controller having means for:

calculating a value T of said gradient angle using a first equation, $$T = \frac{B_L - B_R}{W},$$

wherein W is a width of said workpiece plate, $B_L$ and $B_R$ are said trial bend values respectively corresponding to a left end trial bend value and a right end trial bend value and said at least two measurement positions along said reference edge are positions at a left end and a right end of said workpiece plate;

calculating a corrective displacement $H_L$ for said horizontal stop surface left end using a second equation, $$H_L = B - B_L - T \cdot D_L,$$

wherein B is said target bend value and $D_L$ is a distance from said left end of said workpiece plate to said left axis of said left drive means; and calculating a corrective displacement $H_R$ for said horizontal stop surface right end using a third equation, $$H_R = B - B_R - T \cdot D_R,$$

wherein $D_R$ is a distance from said right end of said workpiece plate to said right axis of said right drive means;

said controller being configured to drive said drive mechanism to displace said horizontal stop surface in accordance with said corrective displacement including said controller having means for:

calculating a corrective displacement $H_L$ for said horizontal stop surface left end in accordance with a first equation, $$H_L = B - B_L - \frac{1}{W}(B_L - B_R)\left(\frac{L}{2} + F - \frac{W}{2}\right),$$

and calculating a corrective displacement $H_R$ for said horizontal stop surface right end in accordance with a second equation, $$H_R = B - B_R - \frac{1}{W}(B_L - B_R)\left(\frac{L}{2} - F - \frac{W}{2}\right),$$

wherein W is a width of said workpiece plate, B is said target bend value, L is a distance between said left axis and said right axis, and F is an offset distance between a center of the workpiece plate and center between said left axis and said right axis, and $B_L$ is a left end trial bend value and $B_R$ is a right end trial bend value and said at least two measurement positions are respectively at a left end and a right end of said workpiece plate; and said controller being configured to drive said drive mechanism to displace said horizontal stop surface in accordance with said corrective displacement including said controller having:

means for driving said left drive means to displace said horizontal stop surface left end in accordance with said corrective displacement $H_L$; and means for driving said right drive means to displace said horizontal stop surface right end in accordance with said corrective displacement $H_R$.

22. An apparatus for bending a workpiece plate comprising:

a press brake having a back gauge unit with a stop member means for positioning a workpiece and a bend tool;

said stop member means defining a horizontal stop surface for engaging and positioning a reference edge of said workpiece plate, said horizontal stop surface having a horizontal stop surface left end and a horizontal stop surface right end;

a drive mechanism for positioning said stop member means to move said horizontal stop surface relative to said bend tool, said drive mechanism including:

a left drive means for displacing said horizontal stop surface left end along a left axis in a first direction perpendicular to a longitudinal bend direction of said bend tool;

a right drive means for displacing said horizontal stop surface right end along a right axis in said first direction; and means for operating said left drive means and said right drive means to effect differing displacements for rotating said horizontal stop surface relative to said longitudinal bend direction to vary a gradient angle defined by an orientation of said horizontal stop surface relative to said longitudinal bend direction;

said brake press having a controller for controlling said drive mechanism, accepting and storing a target bend value indicating a position on said workpiece plate for a bend to be made by said bend tool relative to said reference edge of said workpiece plate, and for accepting trial bend values indicating measured positions of a trial bend relative to said reference edge at at least two measurement positions along said reference edge;

said controller being configured to calculate an initial position of said horizontal stop surface relative to a plane of operation of said bend tool based on said target bend value and to drive said drive mechanism to position said horizontal stop surface at said initial position;

said controller being configured to calculate a corrective displacement including said controller having means for:

calculating a corrective displacement $H_L$ for said horizontal stop surface left end in accordance with a first equation, $$H_L = B - B_L - \frac{1}{W}(B_L - B_R)\left(\frac{L}{2} + F - \frac{W}{2}\right),$$

and calculating a corrective displacement $H_R$ for said horizontal stop surface right end in accordance with a second equation, $$H_R = B - B_R - \frac{1}{W}(B_L - B_R)\left(\frac{L}{2} - F - \frac{W}{2}\right),$$

wherein W is a width of said workpiece plate, B is said target bend value, L is a distance between said left axis and said right axis, and F is an offset distance between a center of the workpiece plate and center between said left axis and said right axis, and $B_L$ is a left end trial bend value and $B_R$ is a right end trial bend value and said at least two measurement positions are respectively at a left end and a right end of said workpiece plate; and said controller being configured to drive said drive mechanism to displace said horizontal stop surface in accordance with said corrective displacement including:

means for driving said left drive means to displace said horizontal stop surface left end in accordance with said corrective displacement $H_L$; and means for driving said right drive means to displace said horizontal stop surface right end in accordance with said corrective displacement $H_R$.

* * * * *